US008177965B2

(12) United States Patent
Leta et al.

(10) Patent No.: US 8,177,965 B2
(45) Date of Patent: May 15, 2012

(54) ENHANCEMENT OF SATURATES CONTENT IN HEAVY HYDROCARBONS UTILIZING ULTRAFILTRATION

(75) Inventors: Daniel P. Leta, Flemington, NJ (US); Eric B. Sirota, Flemington, NJ (US); Edward W. Corcoran, Easton, PA (US); Anjaneya S. Kovvali, Fairfax, VA (US); Stephen H. Brown, Bernardsville, NJ (US); Stephen M. Cundy, Lebanon, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 470 days.

(21) Appl. No.: 11/980,157

(22) Filed: Oct. 30, 2007

(65) Prior Publication Data

US 2009/0057203 A1 Mar. 5, 2009

Related U.S. Application Data

(60) Provisional application No. 60/966,469, filed on Aug. 28, 2007.

(51) Int. Cl.
*C07C 7/144* (2006.01)

(52) U.S. Cl. ..... 208/308; 208/309; 585/818; 585/819

(58) Field of Classification Search ..... None
See application file for complete search history.

(56) References Cited

U.S. PATENT DOCUMENTS

| | | | |
|---|---|---|---|
| 2,947,687 | A | 10/1954 | Lee |
| 3,684,697 | A | 8/1972 | Gamson |
| 3,919,075 | A | 11/1975 | Parc et al. |
| 3,990,963 | A | 11/1976 | Audibert et al. |
| 4,115,465 | A | 9/1978 | Elfert et al. |
| 4,120,900 | A | 10/1978 | Evers et al. |
| 4,134,824 | A | 1/1979 | Kamm et al. |
| 4,169,782 | A | 10/1979 | Thompson |
| 4,259,170 | A | 3/1981 | Graham et al. |
| 4,411,790 | A | 10/1983 | Arod et al. |

(Continued)

FOREIGN PATENT DOCUMENTS

CA 2185264 9/1996

(Continued)

OTHER PUBLICATIONS

V. S. Ravi-Kumar, Theodore T. Tsotsis, Muhammad Sahimi; "Studies of Transport of Asphaltenes through Membranes Using Hindered Diffusion Theories for Spheres and Spheroids," Ind. Eng. Chem. Res. 1997, 36, pp. 3154-3162.

(Continued)

*Primary Examiner* — Tam M Nguyen
(74) *Attorney, Agent, or Firm* — Bruce M. Bordelon; David M. Weisberg

(57) ABSTRACT

This invention relates to an ultrafiltration process for separating a heavy hydrocarbon stream to produce an enriched saturates content stream(s) utilizing an ultrafiltration separations process. The enriched saturates content streams can then be further processed in refinery and petrochemical processes that will benefit from the higher content of saturated hydrocarbons produced from this separations process. The invention may be utilized to separate heavy hydrocarbon feedstreams, such as whole crudes, topped crudes, synthetic crude blends, shale oils, oils derived from bitumen, oils derived from tar sands, atmospheric resids, vacuum resids, or other heavy hydrocarbon streams into enriched saturates content product streams. The invention provides an economical method for separating heavy hydrocarbon stream components by molecular species instead of molecular boiling points.

17 Claims, 6 Drawing Sheets

U.S. PATENT DOCUMENTS

| | | | | |
|---|---|---|---|---|
| 4,504,377 | A | 3/1985 | Shu et al. | |
| 4,592,832 | A | 6/1986 | Bristow et al. | |
| 4,617,126 | A | 10/1986 | Funk et al. | |
| 4,661,241 | A | 4/1987 | Dabkowski et al. | |
| 4,797,200 | A | 1/1989 | Osterhuber | |
| 4,814,088 | A | 3/1989 | Kutowy et al. | |
| 4,816,140 | A | 3/1989 | Trambouze et al. | |
| 4,874,523 | A | 10/1989 | LaFreniere | |
| 4,892,660 | A | 1/1990 | Sweet | |
| 4,908,134 | A | 3/1990 | Anderson | |
| 4,946,594 | A | 8/1990 | Thaler et al. | |
| 4,963,303 | A | 10/1990 | Anderson | |
| 4,978,454 | A | 12/1990 | Sweet | |
| 4,982,051 | A | 1/1991 | Pasternak et al. | |
| 5,045,206 | A | 9/1991 | Chen et al. | |
| 5,045,354 | A | 9/1991 | Feimer et al. | |
| 5,107,056 | A | 4/1992 | Chen et al. | |
| 5,107,058 | A | 4/1992 | Chen et al. | |
| 5,107,059 | A | 4/1992 | Chen et al. | |
| 5,173,172 | A | 12/1992 | Adams et al. | |
| 5,180,496 | A | 1/1993 | Sartori et al. | |
| 5,191,151 | A | 3/1993 | Eriksen et al. | |
| 5,256,297 | A | 10/1993 | Feimer et al. | |
| 5,514,252 | A | 5/1996 | Kerby, Jr. et al. | |
| 5,635,055 | A | 6/1997 | Sweet et al. | |
| 5,643,442 | A | 7/1997 | Sweet et al. | |
| 5,749,943 | A | 5/1998 | Shimazu et al. | |
| 5,785,860 | A | 7/1998 | Smith | |
| 5,979,178 | A | 11/1999 | Engler et al. | |
| 6,180,008 | B1 | 1/2001 | White | |
| 6,187,987 | B1 | 2/2001 | Chin et al. | |
| 6,190,533 | B1 | 2/2001 | Bradow et al. | |
| 6,524,469 | B1 | 2/2003 | Schucker | |
| 6,525,469 | B1 | 2/2003 | Huang et al. | |
| 6,896,796 | B2 | 5/2005 | White et al. | |
| 7,018,517 | B2 | 3/2006 | Kurita et al. | |
| 7,041,212 | B2 | 5/2006 | White et al. | |
| 7,048,846 | B2 | 5/2006 | White et al. | |
| 2003/0019790 | A1 | 1/2003 | Schucker | |
| 2004/0026321 | A1 | 2/2004 | Minhas et al. | |
| 2004/0251166 | A1 | 12/2004 | Alvarenga Baptista et al. | |
| 2004/0251201 | A1 | 12/2004 | Chau et al. | |
| 2005/0154247 | A1* | 7/2005 | Jong et al. | 585/862 |
| 2006/0016727 | A1 | 1/2006 | Varadaraj | |
| 2006/0231462 | A1 | 10/2006 | Johnson | |
| 2006/0231492 | A1* | 10/2006 | Sabottke et al. | 210/650 |
| 2007/0090020 | A1 | 4/2007 | Buchanan et al. | |
| 2008/0116109 | A1 | 5/2008 | McCoy et al. | |

FOREIGN PATENT DOCUMENTS

| | | | |
|---|---|---|---|
| EP | 0160142 | | 11/1985 |
| EP | 0254359 | B1 | 1/1988 |
| EP | 0146298 | B1 | 5/1991 |
| EP | 0489573 | B1 | 9/1995 |
| GB | 1266180 | | 12/1969 |
| GB | 2268186 | | 1/1994 |
| JP | 54013509 | | 7/1977 |
| JP | 2000288371 | | 4/1999 |
| JP | 2001038159 | | 8/1999 |
| KR | 2002007235 | | 1/2002 |
| WO | WO 00/06526 | | 2/2000 |
| WO | WO 01/60771 | A1 | 8/2001 |
| WO | WO 02/50212 | A2 | 6/2002 |
| WO | WO 03/026781 | A1 | 4/2003 |
| WO | WO 2004/018067 | A2 | 3/2004 |
| WO | WO 2006/040328 | A1 | 4/2006 |

OTHER PUBLICATIONS

Anna Duong, Goutam Chattopadhyaya, Wellington Y. Kwok, Kevin J. Smith; "An experiment study of heavy oil ultrafiltration using ceramic membranes," Fuel, vol. 76, No. 9, pp. 821-828, 1997.

B. D. Sparks, J. D. Hazlett, O. Kutowy, T. A. Tweddle; "Upgrading of Solvent Extracted Athabasca Bitumen by Membrane Ultrafiltration," AIChe Journal, Aug. 1990, vol. 36, No. 8, pp. 1279-1282.

Bruce Bishop, Robert Goldsmith, Robert Schucker, Keith Rawlins; "Ceramic Membrane Process for Upgrading Vacuum Residual Oil," Presentation at AIChE 2004 Spring Annual Meeting, New Orleans, LA, Apr. 25-29, 89d.

W. C. Lai, K. J. Smith; "Heavy oil microfiltration using ceramic monolith membranes," Fuel 80 (2001) pp. 1121-1130.

J. D. Hazlett, O. Kutowy, T. A. Tweddle, B. A. Farnand; "Processing of crude oils with polymeric ultrafiltration membranes," AIChE 1989 Spring National Meeting (Houston Apr. 2-Jun. 1989) AIChE Symposium Series V85 N. 272, 101-107 (1989).

Deqing Shi, Hongwei Yu, Jinrong Yang, Zhihau Zhang,Ying Kong; "Study on the separation performance of polyimide nanofiltration membrane for solvent recovery in the butanone-toluene dewaxing process of lube oil," Mo Kexue Yu Jishu (2005), 25(3), 50-53, 62. Abstract.

Zhi-Ping Zhao, Jiding Li, Jian Chen, Cui-Xian Chem; "Nanofiltration membrane prepared from polyacrylonitrile ultrafiltration membrane by low-temperature plasma," Journal of Membrane Science (2005), 251(1-2), 239-245. Abstract.

F. Petrus Cuperus, Katrin Ebert; "Non-aqueous application of NF," Nanofiltration (2005), 521-536, Editor(s): Schafer, A.I.; Fane, A.G.; Waite, Thomas D., Publisher: Elsevier Ltd., Oxford, UK. Abstract.

B. Bishop, R. Goldsmith, R. Schucker, K. Rawlins; "Ceramic membrane process for upgrading vacuum residual oil," 2004 AIChE Spring Meeting, Conference Proceedings, New Orleans, LA, 7p (2004) Abstract.

M. V. Veazey; "Tech trends: Microfiltration system," Materials Performance 43/5 15 (May 2004), Abstract.

T. Melin, M. Gallenkemper, J. Hoppe, C. Matthias, "Achema reports. Membrane engineering," Chemie-Ingenieur-Technik (Achema 2003 27(sup) t(sup) h International Exhibition—Congress on Chemical Engineering, 76/12 1869-1876, Dec. 2003., Abstract.

V. I. Il'in, V. A. Kolesnikov, A. V. D'Yachenko; "Electrically insulating petroleum oils and their refining," Oboronnyi Kompleks—Nauchno-Telchnicheskomu Progressu Rossii (2002), (4), 69-71. Abstract.

A. P. Aleksandrin, A. A. Egorshev, O. V. Katsereva, E. A. Komyagin, V. N. Mynin, G. V. Terpugov; "Use of ceramic membranes for treatment end regeneration of depleted petroleum products," Tyazh. Mashinostr. -/6 30-32 (2002) Chemical Abstracts 138/5-6 Abstr. No. 58512 (2003). Abstract.

"Process industries exposition: Membrane rejects emulsified oils while maintaining hydrophilic properties," Chemical Engineering Progress 97/4 26 (Apr. 2001). Abstract.

K. J. Smith, W. C. Lai; "Heavy oil microfiltration using ceramic monolith membranes," Fuel, 80/8, 1121-1130 (Jun. 2001). Abstract.

R. M. Gould, L. S. White, C. R. Wildemuth; "Membrane separation in solvent lube dewaxing," Environmental Progress, 20/1, 12-16 (Apr. 2001). Abstract.

N. A. Bhore, R. M. Gould, S. M. Jacob, P. O. Staffeld, D. McNally, P. H. Smiley, C. R. Wildemuth; "New membrane process debottlenecks solvent dewaxing unit," Oil and Gas Journal, 97/46, 67-68, 70, 72-24 (1999 1115). Abstract.

Jiao-Li Li, Xu-Xiang Li, Bing-Hua Ni; "Development of ultrafiltration and its application in recovery of dewaxing solvent," Shihua Jishu Yu Yingyong (2000), 18(5), 295-297, 301. Abstract.

S. Elmaleh, N. Ghaffor; "Upgrading oil refinery effluents by cross-flow ultrafiltration," Water Science & Technology, 34(9), 231-238 (1996), Aqualine Abstracts Abstr. No. 97-4463 V13 N.9 (Sep. 1997). Abstract.

B. Park, V. S. Ravi-Kumar, T. T. Tsotsis; "Models and simulation of liquid—phase membrane reactors," Industrial & Engineering Chemistry Research, V37 N. 4, 1276-89 (Apr. 1998). Abstract.

A. Duong, K. J. Smith; "A model of ceramic membrane fouling during heavy oil," Canadian Journal of Chemical Engineering, V75 N. 6, 1122-29 (Dec. 1997). Abstract.

M. Garcia Sanchez, J. L. Perez Pavon, B. Moreno Cordero; J. Chromatogr., A, 766 (1+2), 61-69 (1997) Chemical Abstracts Abstr. No. 319181 V126 N. 24. Abstract.

V. S. Ravi-Kumar, T. T. Tsotsis, M. Sahimi; "Studies of the transport of asphaltenes through membranes using hindered diffusion theories for spheres and spheroids," Industrial & Engineering Chemistry Research, V36 N. 8, 3154-62 (Aug. 1997). Abstract.

V. S. Ravi-Kumar, L. Yang, T. T. Tsotsis; "Liquid-phase reactive applications with inorganic membranes : Models and experiments,"

ACS 214th National Meeting (Las Vegas Sep. 7-Nov. 1997) Book of Abstracts Part 2 Abstr. No. PMSE-273 (1997). Abstract.
A. Duong, G. Chattopadhyaya, W. Y. Kwok, K. J. Smith; "An experimental study [using Cold Lake (Alberta) oil] of heavy oil ultrafiltration using [single-tube] ceramic membranes," Fuel, V76, N. 9, 821-28 (Jul. 1997). Abstract.
S. Elmaleh, N. Ghaffor; "Upgrading oil refinery effluents by cross-flow ultrafiltration," Water Sci. Technol., 34(9), Water Quality International '96 Part (2), 231-238 (1996) Chemical Abstracts Abstr. No. 79315, V126 N. 6. Abstract.
E. Beaver, Siegel; 'Technologies critical to a changing world / Clean technologies), AIChE et al. 5th World Chemical Engineering Congress (San Diego Jul. 14-18, 1996) Summary Proceedings 100-03; 159-61 (Oct. 1996). Abstract.
W. Ying, B. Tansel; "Effect of coagulation on fouling rate and cleanability of ultrafiltration membranes," Purdue University 50th Industrial Waste Conference (West Lafayette, IN May 8-10, 1996) Proceedings 285-95 (1995). Abstract.
J. L. Humphrey; "Separation processes: Playing a critical role," Chemical Engineering Progress, V91, N. 10, 31-41 (Oct. 1995). Abstract.
V. N. Zrelov, N. G. Postnikova, L. V. Krasnaya; "Rapid membrane (diffusion) methods for determining mechanical impurities in liquid petroleum products," Khimiya I Tekhnologiya Topliv i Masel, N. 4, 28-30 (1994). Abstract.
B. D. Sparks, J. D. Hazlett, O. Kutowy, T. A. Tweddle, Union Carbide Corp.; "Upgrading of solvent extracted Athabasca bitumen by membrane ultrafiltration," AIChE Journal V36, N. 8, 1279-82 (Aug. 1990). Abstract.
R. J. Torres-Ordonez, S. G. Kukes, F. S. Lee, D. C. Cronauer; "Characterization of solids from coal/resid(ue) coprocessing," ACS 200th National Meeting (Washington, DC Aug. 26-31, 1990) ACS Division of Fuel Chemistry Preprints V35 N.4, 1048-55 (1990). Abstract.
J. D. Hazlett, O. Kutowy, T. A. Tweddle, B. A.Farnand; "Processing of Crude Oils with Polymeric Ultrafiltration Membranes," Nat'l. Res. Counc. Can.; Can. Cent. Miner. Energy Technol, 1989 AIChE Spring Nat'l Meeting (Houston Apr. 2-6, 1989), Prepr. N. 64f 18P.
B. D. Sparks, J. D. Hazlett, O. Kutowy, T. A. Tweddle; "Upgrading of solvent extracted Athabasca bitumen by Membrane ultrafiltration," AIChE 1987 Summer Natl. Meet. (Minneapolis Aug. 16-19, 1987 Prepr. N. 7D 22P. Abstract.
M. Nishimura; "Application and development of membrane separation processes in oil chemistry and its related fields," Yakagaku, 34(3), 171-7 (1985), Chem. Abstr. Abstr. No. 168846 V102 N.20. Abstract.
D. S. Schuster, C. A. Irani; "Understanding the pour point depression mechanism—2, microfiltration analysis of crude oils," 189th ACS Natl. Meet. (Miami Beach Apr. 28-May 3, 1985) ACS Div. Fuel Chem. Prepr. V30 N.1, 169-77 (1985). Abstract.
J. Durandet; "Separation (Processes) in the refining industry/introduction separations dans le raffinage/introduction," Pet. Tech. N.298 5-6 (May 1983). Abstract.
J. Briant, G. Hotier; "The state of asphaltenes in hydrocarbon mixtures the size of molecular clusters," Rev. Inst. Fr. Pet. V38 N.1 83-100 (Jan.-Feb. 1983). Abstract.
D. Defives, R. Avrillon, C. Miniscloux, R. Roullet, X. Marze; "Regeneration of used lubricating oils by ultrafiltration," Informations Chimie (1978), 175, 127-31. Abstract.
A. Duong, K. Smith, JCS University of British Columbia; Canadian Journal of Chemical Engineering V75 N. 6, 1122-29 (Dec. 1997). Abstract.
V. N. Zrelov, N. G. Postnikova, L. V. Krasnaya; "Analytical filtration of petroleum and synthetic products through membranes," Khim. Tekhnol. Topl. Masel (1984), (11), 32-4. Abstract.
R. J. Thrash, R. H. Pildes; "The diffusion of Petroleum asphaltenes (from a Middle East high-sulfur vacuum residuum) through well characterized (MICA) porous membranes," 181st ACS Natl. Meet (Atlanta Mar. 29-Apr. 3, 1981) ACT Div. Pet. Chem. Prepr. V26 N.2515-25 (Mar. 1981). Abstract.
D. D. Spatz; "Ultrafiltration . . . The membranes, the process, and its application to organic molecule fractionation (Including industrial oil/water separations," 178th ACS Natl. Meet. (Washington, DC Sep. 9-14, 1979) Abstr. Pap. Abstr No. Coll-125. Abstract.
G. Sartori, W. S. Ho, R. E. Noone, B. H. Ballinger; "(New) poly(fluoroolefin) membranes for aromatics/saturates separation," AIChE 1997 Annual Meeting (Los Angeles Nov. 16-21, 1997) Preprint N.32d 6P. Abstract.
V. S. Ravi-Kumar, I. A. Webster, T. T. Tsotsis, R. C. Sane, M. Sahimi; "Studies of diffusion of petroleum liquid macromolecules through model membranes," AIChE 1992 Annual Meeting (Miami Beach Nov. 1-5, 1992) Preprint N.22g 3P. Abstract.
R. C. Sane, I. A. Webster, T. T. Tsotsis, V. S. Ravi-Kumar; "Studies of asphaltene diffusion and structure and their implications for resid(uum) upgrading," 12th International "Chemical Reaction Engineering Today" Symposium (Turin, Italy Jun. 28-Jul. 1, 1992) Chemical Engineering Science V47 N.9-11 2683-88 (Jun.-Aug. 1992). Abstract.
R. C. Sane; "The diffusion of petroleum asphaltenes in porous membranes," University of Southern California, Dissertation (1991) (Abstract) Dissertation Abstracts International: Section B Science & Engineering V52 N.8 4350-B (Feb. 1992). Abstract.
Yong Woo Rho, Hwayong Kim, Won Hee Park; "Effect of oil viscosity on ultrafiltration flux," Hwahak Konghak (1989), 27(4), 446-50. Abstract.
Yujun Song, Fuan Liu, Yong Yang, Jian Zou, Benhui Sun, Tianyuan Zhong; "Review on the preparation and application of nanofiltration membrane," Huagong Keji (1999), 7(3), 1-7. Abstract.
May-Britt Haag; "Membranes in chemical processing. A review of applications and novel developments," Separation and Purification Methods (1998), 27(1), 51-168. Abstract.
H. Zuern, K. Kohlhase,K. Redden, J. Weitkamp; "Developments in refinery technology—1. Process technology, processing of crudes, residua, and heavy oils," 50th DGMK Anniv. Meet (Berline Nov. 24-26, 1983) Erdoel Kohle, Erdgas, Petrochem. Brennst. Chem. V37 N.2 52-69 (Feb. 1984). Abstract.
R. E. Baltus, J. L. Anderson; "Hindered diffusion of asphaltenes through microporous membranres," Chemical Engineering Science (1983), 38(12) 1959-69. Abstract.
A. Duong, K. J. Smith; "A model of ceramic membrane fouling during heavy oil utlrafiltration," Canadian Journal of Chemical Engineering V75 N.6 1122-29 (Dec. 1997). Abstract.

* cited by examiner

ENHANCEMENT OF SATURATES CONTENT IN HEAVY HYDROCARBONS UTILIZING ULTRAFILTRATION

This application claims the benefit of U.S. Provisional Application No. 60/966,469 filed Aug. 28, 2007.

FIELD OF THE INVENTION

This invention relates to a process for separating a heavy hydrocarbon stream to produce an enriched saturates content stream(s) utilizing an ultrafiltration separations process. The enriched saturates content streams can then be further processed in refinery and petrochemical processes that will benefit from the higher content of saturated hydrocarbons produced from this separations process. The invention may be utilized to separate heavy hydrocarbon feedstreams, such as whole crudes, topped crudes, synthetic crude blends, shale oils, oils derived from bitumens, oils derived from tar sands, atmospheric resids, vacuum resids, or other heavy hydrocarbon streams into enriched saturates content product stream(s). The invention provides an economical method for separating heavy hydrocarbon stream components by molecular species instead of molecular boiling points.

BACKGROUND OF THE INVENTION

As the demand for hydrocarbon-based fuels has increased, the need for improved processes for separating hydrocarbon feedstocks of heavier molecular weight has increased as well as the need for increasing the conversion of the heavy portions of these feedstocks into more valuable, lighter fuel products. These heavier, "challenged" feedstocks include, but are not limited to, low API gravity, high viscosity crudes from such areas of the world as the Middle East, Mexico, Venezuela, and Russia, as well as less conventional refinery feedstocks derived from such sources as bitumen, shale oil and tar sands. It is also important that heavy crude fractions, such as atmospheric resids, vacuum resids, and other similar intermediate feedstreams containing boiling point materials above about 850° F. are processed in such a manner so as to improve their ability to be utilized as feedstreams for subsequent refining and petrochemical processes such as, but not limited to, fuels blending, fuels upgrading, catalytic conversion, steam cracking, and lube oils production and upgrading.

Most crude oils and synthetic crude oils derived from such raw materials as bitumen, shale oil and tar sands are processed through initial separations units such as a crude unit that are designed to boil and distill lighter boiling point fractions from the heavier boiling point crude fractions. The majority of these boiling point fractions are sent to other refinery and petrochemical processes for further refinement depending upon their molecular content characteristics, while a smaller amount of these crude unit fractions are sent to finished product treatment and/or product blending.

One problem that exists is that these conventional separations units require a significant amount of energy to generate these distillation based separations. Most crude units have at least one atmospheric distillation train and at least one vacuum distillation train. Often crude units also have additional crude intermediate or auxiliary distillation trains. Each of these unit trains require the hydrocarbon feed to the train to be heated to temperatures of about 750° F. to about 850° F. prior to entering a distillation column associated with each train. In turn, each of these distillation columns normally requires multiple reflux circuits and possible intermediate column reheat circuits in order to properly control and achieve proper separation of the individual fractions obtained from the distillation. Not only does this arrangement require a significant amount of equipment and associated capital and maintenance costs, but these conventional processes require large amounts of input energy as well as a large array of sophisticated controls and skilled personnel for proper operation.

Another problem that exists in the art with heavy oils separations is that these crude distillation processes only separate the molecules of the feedstreams by boiling point. Therefore, molecules with close boiling points are removed together in a single fraction from the crude distillation processes. In particular saturated and aromatic hydrocarbons with the same or close carbon content (for example hexane and benzene which both have 6 carbon atoms) cannot be easily separated by commercial crude distillation processes and both molecules remain in a single stream of the crude unit fractions. Additionally, these types of molecules are very difficult to separate in subsequent refinery and petrochemical processes especially in distillation based processes. Most of the subsequent separations processes either rely on solution extraction processes or on other characteristics of the molecules such as their freeze points in order to separate these different close boiling point compounds. Therefore, as these ancillary processes tend to be expensive and very "targeted" as to the separations being achieved, typical refinery and petrochemical aromatics/saturates separations processes are generally limited to processes wherein a specific, small boiling point range of compounds are involved in the separation and/or wherein the separations must be made to within a high degree of purity.

Therefore, there exists in the industry a need for improved low energy refinery and petrochemical processes that can achieve a separation of hydrocarbon components by molecular species, in lieu of separations by molecular weight or boiling points. Even greater is the need for a relatively simple, low energy saturated hydrocarbons separations process that can make a bulk separation of high saturates content product streams from a heavy hydrocarbon feedstream, preferably a crude oil or crude resid hydrocarbon stream, without the use of conventional technologies for the separation of targeted molecular species such as extractive solvent processes.

SUMMARY OF THE INVENTION

This invention includes an ultrafiltration process for separating a heavy hydrocarbon containing stream to produce a permeate product stream with increased saturated hydrocarbons content stream utilizing an ultrafiltration separations process. In preferred embodiments, this invention may be utilized to separate heavy hydrocarbon feedstreams, such as whole crudes, topped crudes, synthetic crude blends, shale oils, oils derived from bitumens, oils derived from tar sands, atmospheric resids, vacuum resids, or other heavy hydrocarbon streams to produce a permeate product stream with increased saturated hydrocarbons content stream.

An embodiment of the present invention is a process for separating a heavy hydrocarbon stream, comprising:

a) contacting the heavy hydrocarbon stream with at least one porous membrane element in a membrane separation zone wherein the heavy hydrocarbon stream contacts a first side of the porous membrane element;

b) retrieving at least one permeate product stream from a second side of the porous membrane element, wherein the permeate product stream is comprised of selective materials which pass through the porous membrane element from the first side of the porous membrane element and are retrieved in the permeate product stream from the second side of the porous membrane element;

c) retrieving at least one retentate product stream from the first side of the porous membrane element;

d) conducting at least a portion of the permeate product stream to a first atmospheric distillation column;

e) retrieving a first atmospheric resid stream from the first atmospheric distillation column; and f) conducting at least a portion of the first atmospheric resid stream to a first vacuum distillation column;

wherein the ratio of the saturates wt % content of the permeate product stream to the saturates wt % content of the heavy hydrocarbon stream is greater than 1.0.

Another embodiment of the present invention is a process for separating a heavy hydrocarbon stream, comprising:

a) conducting a heavy hydrocarbon stream to an atmospheric distillation column;

b) retrieving an atmospheric resid stream from the atmospheric distillation column;

c) contacting at least a portion of the atmospheric resid stream with at least one porous membrane element in a membrane separation zone wherein the atmospheric resid stream contacts a first side of the porous membrane element;

d) retrieving at least one permeate product stream from a second side of the porous membrane element, wherein the permeate product stream is comprised of selective materials which pass through the porous membrane element from the first side of the porous membrane element and are retrieved in the permeate product stream from the second side of the porous membrane element;

e) retrieving at least one retentate product stream from the first side of the porous membrane element;

f) conducting at least a portion of the permeate product stream to a first vacuum distillation column; and g) retrieving a first vacuum resid stream from the first vacuum distillation column;

wherein the ratio of the saturates wt % content of the permeate product stream to the saturates wt % content of the heavy hydrocarbon stream is greater than 1.0.

Another embodiment of the present invention is process for separating a heavy hydrocarbon stream, comprising:

a) contacting the heavy hydrocarbon stream with at least one porous membrane element in a membrane separation zone wherein the heavy hydrocarbon stream contacts a first side of the porous membrane element;

b) retrieving at least one permeate product stream from a second side of the porous membrane element, wherein the permeate product stream is comprised of selective materials which pass through the porous membrane element from the first side of the porous membrane element and are retrieved in the permeate product stream from the second side of the porous membrane element;

c) retrieving at least one retentate product stream from the first side of the porous membrane element;

d) conducting at least a portion of the permeate product stream to a storage tank;

e) conducting at least a portion of the permeate product stream from the storage tank to an atmospheric distillation column;

f) retrieving a first atmospheric resid stream from the first atmospheric distillation column; and g) conducting at least a portion of the first atmospheric resid stream to a first vacuum distillation column;

wherein the ratio of the saturates wt % content of the permeate product stream to the saturates wt % content of the heavy hydrocarbon stream is greater than 1.0.

In other preferred embodiments, the porous membrane element is comprised of a material selected from ceramics, metals, glasses, polymers, and combinations thereof. In yet other preferred embodiments, the porous membrane element has an average pore size of about 0.001 to about 2 microns.

In other embodiments, the hydrocarbon stream in the membrane separation zone is maintained from about 100 to about 350° C. In still other embodiments, the transmembrane pressure across the porous membrane element is at least 400 psig.

DETAILED DESCRIPTION OF THE PREFERRED EMBODIMENTS

Figure 1:
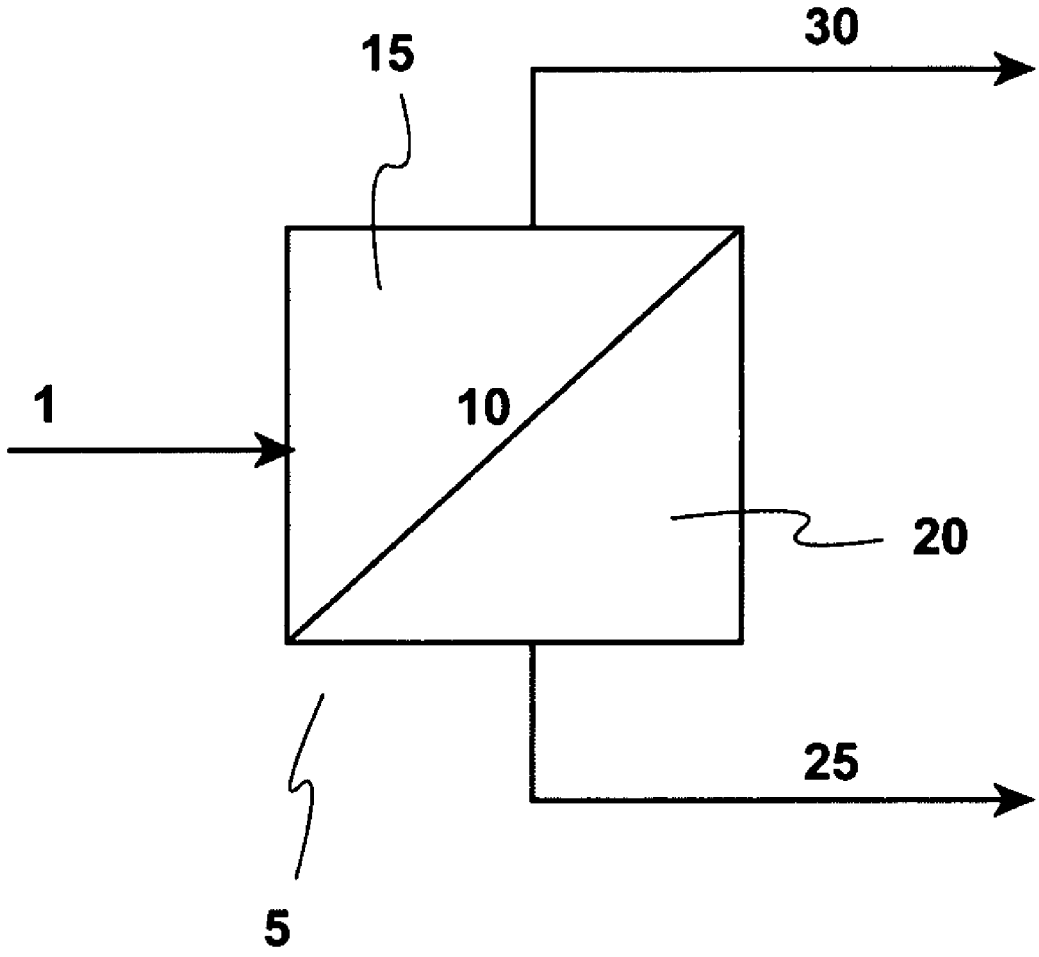
FIG. 1 illustrates one embodiment of the ultrafiltration process of the present invention wherein a heavy hydrocarbon feedstream is separated into a saturates enriched product stream and a saturates depleted product stream.

This invention includes an ultrafiltration process for separating a heavy hydrocarbon stream to produce an enriched saturates content stream utilizing an ultrafiltration separations process. In preferred embodiments, this invention may be utilized to separate heavy hydrocarbon feedstreams, such as whole crudes, topped crudes, synthetic crude blends, shale derived oils, oils derived from bitumens, oils derived from tar sands, atmospheric resids, vacuum resids, or other heavy hydrocarbon streams to produce an enriched saturates content stream(s). Some of the terms utilized herein are defined as follows.

The term "saturates", "saturated compounds", or "saturated hydrocarbons" as used herein is defined as a hydrocarbon molecule containing only single molecular bonds (i.e., no double or triple molecular bonds). The term "aromatics" as used herein is defined as a compound molecule which includes a ringed molecular structure containing a delocalized π-electron system wherein the ring is comprised of at least one carbon atom and the ring contains at least one double molecular bond.

The term "average boiling point" as used herein is defined as the mass weighted average boiling point of the molecules in a mixture. This may be determined by simulated distillation gas chromatography (also referred to herein as "SIMDIS"). The term "initial boiling point" as used herein is defined as the temperature at which 5 wt % of the mixture is volatized at atmospheric (standard) pressure. The term "final boiling point" as used herein is defined as the temperature at which 95 wt % of the mixture is volatized at atmospheric (standard) pressure.

The term "hydrocarbon feedstream" or "hydrocarbon stream" as used herein is defined as a fluid stream that is comprised at least 80% hydrocarbon containing compounds by weight percentage.

The term "heavy hydrocarbon" or "heavy hydrocarbon feedstream" as used herein is defined as a hydrocarbon containing composition wherein the final boiling point as defined above is at least 1100° F.

The term "transmembrane pressure" as used herein is defined as the difference in pressure as measured across a membrane element being the difference in pressure between the higher pressure feed/retentate side of the membrane element and the lower pressure permeate side of the membrane elements.

The current invention can be utilized to separate a heavy hydrocarbon feedstream into at least one saturates enriched product stream. By use of the term "saturates enriched product stream", it is meant that the wt % content of the saturated compounds in the saturates enriched product stream from the separation process is greater than the wt % content of the saturated compounds in the feedstream to the separation process. Conversely, by use of the term "saturates depleted product stream", it is meant that the wt % content of the saturated compounds in the saturates depleted product stream from the separation process is less than the wt % content of the saturated compounds in the feedstream to the separation process.

An embodiment of the present invention is illustrated in FIG. 1. Here, a heavy hydrocarbon stream (1) is fed to a membrane separations unit (5) of the present invention. In preferred embodiments, the heavy hydrocarbon feedstreams utilized in the present invention are comprised of high molecular weight hydrocarbon compounds wherein the final boiling point the feedstream is greater than about 1100° F. Such feedstreams include, but are not limited to, whole crudes, topped crudes, synthetic crude blends, shale oils, oils derived from bitumens, oils derived from tar sands, atmospheric resids, vacuum resids, as well as similar heavy hydrocarbon raw feedstocks, pipelineable intermediate products, or intermediate refining product streams containing components with a final boiling point greater than about 1100° F.

Continuing with FIG. 1, the membrane separations unit (5) contains at least one membrane (10) and the membrane separations unit (5) is comprised of a retentate zone (15) wherein the heavy hydrocarbon feedstream contacts a first side of a permeable membrane and a permeate zone (20), from which at least one permeate product stream (25) is obtained from the opposite or second side of the membrane and such permeate product obtained is comprised of materials that selectively permeate through the membrane (10).

It is preferred that the membranes utilized in the present invention be constructed of such materials and designed so as to withstand prolonged operation at elevated temperatures and transmembrane pressures. In one embodiment of the present invention the membrane is comprised of a material selected from a ceramic, a metal, a glass, a polymer, or combinations thereof. In another embodiment, the membrane comprised of a material selected from a ceramic, a metal, or combination of ceramic and metal materials. Particular polymers that may be useful in embodiments of the present invention are polymers comprised of polyimides, polyamides, and/or polytetrafluoroethylenes provided that the membrane material chosen is sufficiently stable at the operating temperature of the separations process. In preferred embodiments, the membrane material has an average pore size of about 0.001 to about 2 microns (μm), more preferably about 0.002 to about 1 micron, and even more preferably about 0.004 to about 0.1 microns.

Although it is not believed to be necessary to obtain the separations results shown herein, it is preferable that the transmembrane pressure be above about 400 psi. It has been discovered that selective separation of certain components may be enriched at these higher transmembrane pressures. Preferably the transmembrane pressure is at least 700 psi, more preferably at least 1000 psi, even more preferably at least 1200 psi, and most preferably at least 1500 psi. The preferred transmembrane pressure ranges for operation of the present invention are about 400 to about 3000 psi, more preferably about 500 to about 2500 psi, even more preferably about 700 to about 1500 psi.

Also, in other preferred embodiments of the present invention, the temperatures of the heavy hydrocarbon feedstream when contacting the membrane element is from about 100 to about 350° C., and more preferably about 100 to about 300° C. For heavy hydrocarbon feedstreams containing a substantial portion of vacuum resids, the most preferable temperature is about 200 to about 300° C. The current invention can operate at feedstream temperatures above 350° C., but it is preferred that the feedstream be below a temperature wherein thermal cracking of the feedstream is minimized.

Continuing with FIG. 1, the current invention utilizes an ultrafiltration process to separate the feedstream into at least one permeate product stream (25) that is enriched in saturates content and at least one retentate product stream (30) is drawn from the retentate zone (20) of the membrane separations unit (5) and is depleted in saturates content. It should be understood that depending upon more complex arrangements such as multiple internal stages, series or parallel multiple unit operations, and/or membrane unit configurations knowledgeable to those skilled in the art, that more than one membrane may be utilized and that more than one permeate product stream and/or retentate stream may be obtained from the membrane unit. Additionally, the retentate product stream, permeate product stream or any portions thereof may be recycled to the primary retentate zone or any intermediate retentate zone.

In a preferred embodiment, the heavy hydrocarbon feedstream is flowed across the face of the membrane element(s)

in a "cross-flow" configuration. In this embodiment, in the retentate zone, the heavy hydrocarbon feed contacts one end of the membrane element and flows across the membrane, while a retentate product stream is withdrawn from the other end of the retentate zone. As the feedstream/retentate flows across the face of the membrane, a composition selective in saturated compounds content flows through the membrane to the permeate zone wherein it is drawn off as a permeate product stream. In a cross-flow configuration, it is preferable that the Reynolds number in at least one retentate zone of the membrane separations unit be in the turbulent range, preferably above about 2000, and more preferably, above about 4000. In some embodiments, a portion of a retentate stream obtained from the membrane separation units may be recycled and mixed with the feedstream to the membrane separations unit prior to contacting the active membrane.

Example 1 illustrates an embodiment of the present invention wherein the heavy hydrocarbon feedstream utilized in the ultrafiltration process was a commercial grade crude atmospheric distillation column resid product stream. In this example, the transmembrane pressure was held at 1000 psi and the temperature was varied from about 150° C. to about 300° C.

The results from an ultrafiltration process of the present invention from Example 1 are shown in Table 1 herein. As can be seen from the data in Table 1, the saturates content of the permeate products were consistently higher than all of the retentate samples. The permeate samples that were analyzed for saturates content all showed higher wt % saturates than the initial feed. Permeate Sample 1 showed a saturates concentration of 20.5 wt % which is 1.18 times the saturates content of the Atmospheric Resid Feed to the ultrafiltration separations unit. Similarly, the saturates concentration of Permeate Samples 3, 5, and 10 were 27.4 wt %, 33.4 wt %, and 21.0 wt %, respectively, which equates to a saturates content in the permeate ranging from about 1.58 to about 1.93 times the saturates content in the heavy hydrocarbon feed to the ultrafiltration separations unit. As further explained in Example 1, due to the recycle of the retentate stream to the feed supply chamber during the test in Example 1, a better comparison of the actual saturates content of the feedstream at a particular point in the experiment is represented by retentate samples that were taken at nearly the same point in the experiment as its corresponding permeate sample. When the saturates content of the permeate samples were compared to the saturates content of the retentate samples taken at corresponding points in the experiment, the permeate stream obtained achieved saturates contents of about 2.5 times the saturate content of the corresponding retentate (i.e., representative of the saturates content of the corresponding feed at the point in the experiment).

In an embodiment of the present invention, a heavy hydrocarbon feedstream is contacted with a porous membrane element and a permeate product stream is obtained wherein the ratio of the wt % saturates content of the permeate stream to the wt % saturates content of the heavy hydrocarbon feedstream is at least about 1.2. In another embodiment, the ratio of the wt % saturates content of the permeate stream to the wt % saturates content of the heavy hydrocarbon feedstream is at least about 1.5. In a still another embodiment, the ratio of the wt % saturates content of the permeate stream to the wt % saturates content of the heavy hydrocarbon feedstream is at least about 2.0.

Figure 2:
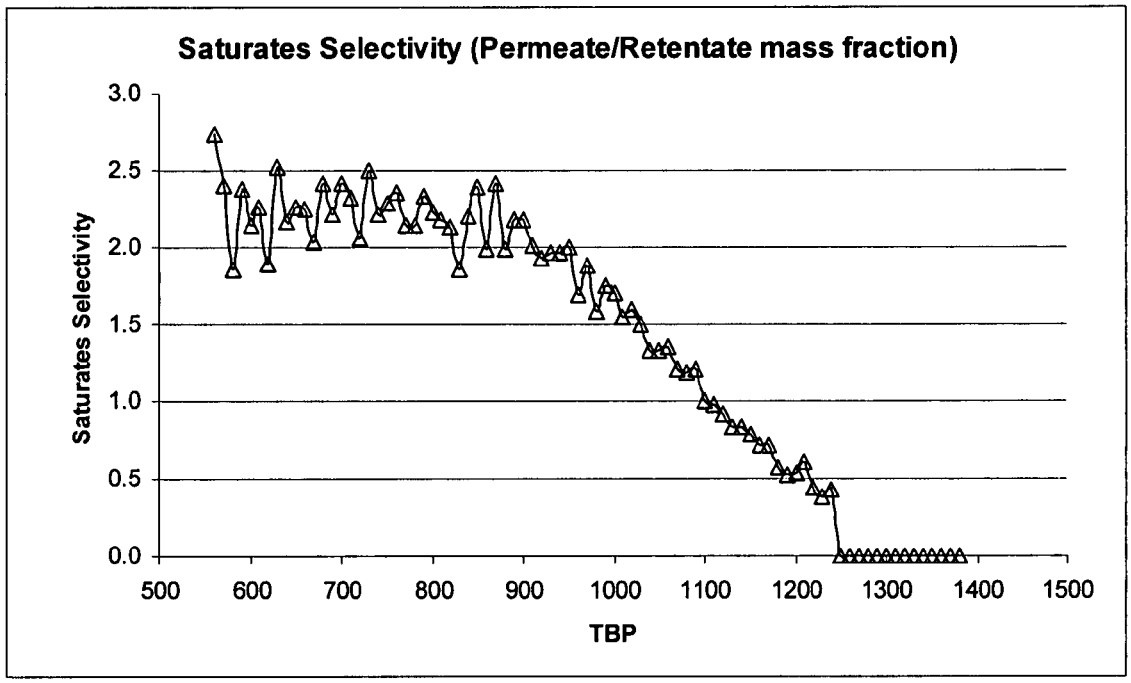
FIG. 2 is a graph of the ratio of the saturates content of a permeate sample to the saturates content of a corresponding retentate sample obtained from one embodiment of the present invention as a function of component boiling points.

Example 2 and corresponding FIG. 2 illustrate the comparison of the saturates content ratios between the permeate and retentate streams as a function of boiling point. As can be seen from FIG. 2, the lower boiling point fractions had better saturates separations than the higher boiling point fractions of the heavy hydrocarbon feed. This is especially beneficial for cases where the permeate stream is further separated by distillation for use as intermediate petrochemical streams such as a steam cracker unit feedstream or a lube plant feedstream or for direct distillation to products such as diesel fuel where the higher saturates content will yield higher product cetane values.

FIG. 2 shows that the ratio of the saturates wt % content in Permeate Sample 5 to the saturates wt % content in Retentate Sample 5 was greater than 1.0 for the saturates components with boiling points less than about 1100° F. Additionally, the average of the saturates wt % content in Permeate Sample 5 to the saturates wt % content in Retentate Sample 5 was greater than about 2.0 for those components with boiling points below about 900° F. It is preferred that the present invention be operated in a regime wherein the ratio of the saturates wt % content of the permeate product to the saturates wt % content of the retentate product is greater than 1.0. In preferred embodiments of the current process invention, the saturates wt % content of the permeate product to the saturates wt % content of the retentate product is greater than 1.2, and even more preferably, the saturates wt % content of the permeate product to the saturates wt % content of the retentate product greater than 1.5 is achieved. In a still more preferred embodiment, the ratio of the wt % saturates content of the permeate stream to the wt % saturates content of the retentate stream obtained from the process is at least about 2.0.

In other preferred embodiments of the process of the current invention, the average of the saturates wt % content of the permeate to the saturates wt % content of the retentate for the components fractions with boiling points below about 900° F. is greater than about 1.5, more preferably greater than about 2.0. Similarly, in preferred embodiments of the process of the current invention, the average of the saturates wt % content of the permeate to the saturates wt % content of the retentate for the components fractions with boiling points below about 1100° F. is greater than about 1.2, more preferably greater than about 1.5.

As discussed above, these saturates enriched product streams are valuable feedstocks for additional upgrading processes in refinery and petrochemical plants. Conversely, the saturates depleted product streams can also be utilized to target specific processes wherein the decreased content of saturated hydrocarbons may be beneficial and may also assist in debottlenecking or increasing the rate on such processes wherein the saturates enriched stream does not require the upgrading or the extent of upgrading and through this process can be excluded from further processing.

Figure 3:
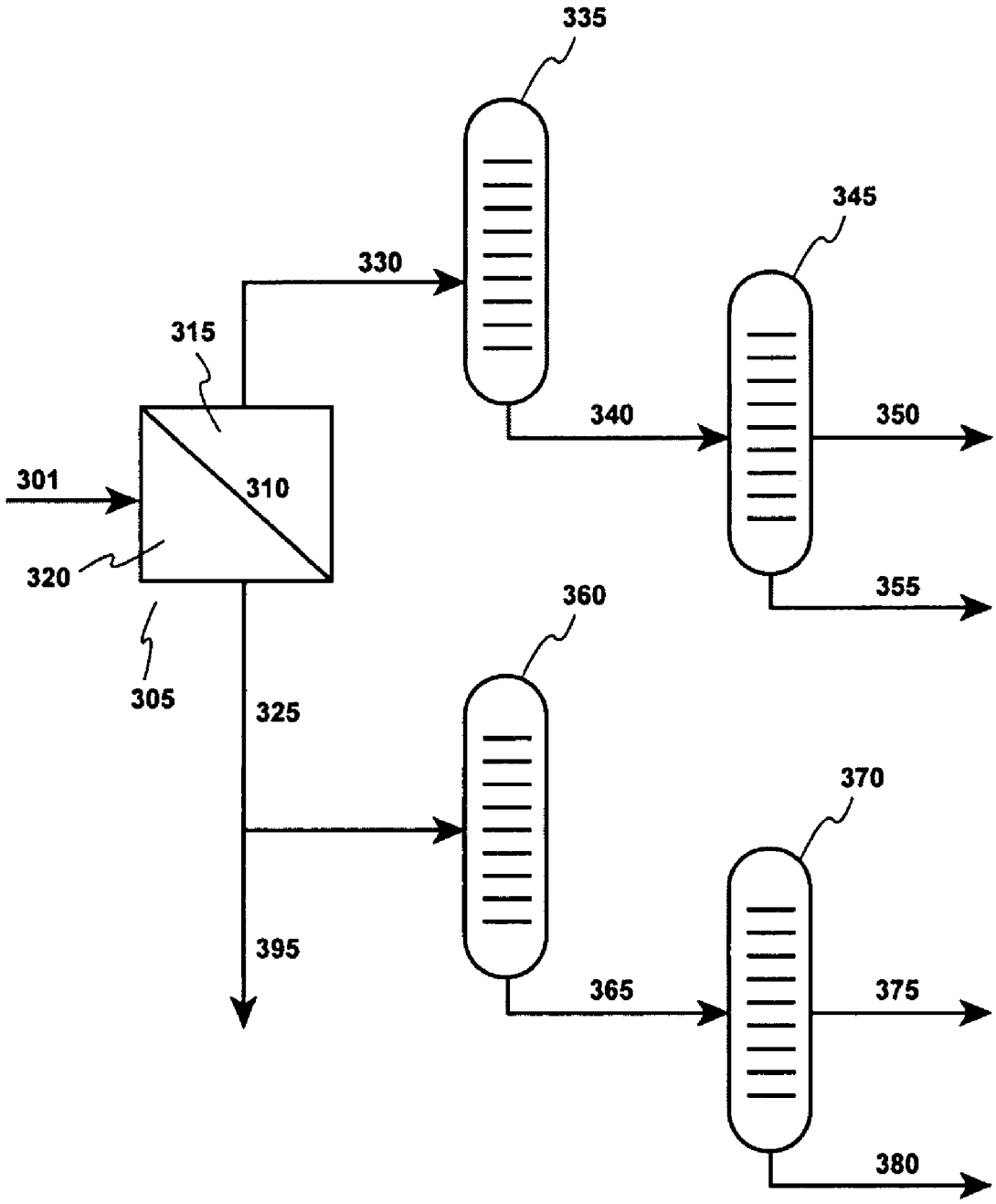
FIG. 3 illustrates one embodiment of the ultrafiltration process of the present invention wherein at least a portion of the saturates enriched permeate product stream and saturates depleted retentate product stream obtained from the ultrafiltration membrane separations are processed in separate atmospheric and vacuum distillation columns and/or at least a portion of the saturates depleted retentate product stream is conducted to another refinery processing unit.

FIG. 3 illustrates one embodiment of the present invention wherein a heavy hydrocarbon feedstream (301), such as whole crudes, topped crudes, synthetic crude blends, shale derived oils, bitumen derived oils, tar sand derived oils, or a portion thereof is fed to the ultrafiltration membrane separations unit (305) where it contacts one side of at least one membrane element (310) in a retentate zone (320) of the membrane separations unit (305). The membrane separates the heavy hydrocarbon feedstream and selectively allows a fluid composition that has an enriched content of saturates material to pass through the membrane into the permeate zone (315) which can be withdrawn as at least one saturates enriched permeate product stream (330). At least one saturates depleted retentate product stream (325) is withdrawn from the retentate zone (320) of the membrane separations unit.

In this embodiment, the saturates enriched permeate product stream (330) or a portion thereof is further processed as a feedstream to a first atmospheric distillation column (335) and a first atmospheric resid stream (340) is drawn from the first atmospheric distillation column and at least a portion of the first atmospheric resid stream is utilized as a feed to a first crude vacuum distillation column (345). The atmospheric resid stream typically is comprised of hydrocarbon compounds with an initial boiling point of at least about 650° F. (343° C.) at atmospheric pressure. For clarity, associated auxiliary equipment as well as optional column distillations are not shown in FIG. 3.

A first vacuum gas oil ("VGO") stream (350) is preferably drawn from the first vacuum distillation column (345). The VGO stream typically has a boiling range of about 650 to about 1050° F. at atmospheric pressure. Since this first VGO stream will be higher in saturates content than if the heavy oil was not first processed in the membrane separations unit (305) of the present invention, the VGO will be of a composition for an improved feed to a steam cracker unit, lubes extraction/dewaxing unit, lubes hydrocracker unit or a lubes hydrodewaxing unit. In a preferred embodiment, at least a portion of the first VGO stream (350) is sent to a steam cracker unit, lubes extraction/dewaxing unit, lubes hydrocracker unit or a lubes hydrodewaxing unit. It should be noted that with the present invention, due to the unique compositional separations it can obtain, it may be possible to make an enriched saturates content VGO from a crude or heavy hydrocarbon feed which may be utilized as a lube basestock feed from crudes or heavy hydrocarbon feeds that otherwise would not be able to produce a VGO stream with properties sufficient to produce commercial grade lubricant oils. This enriched saturates content VGO stream can be an excellent feedstock for producing commercial grade lubricants.

Similarly, the first vacuum resid stream (355) from the first vacuum distillation column (345) will be higher in saturates content than if the heavy hydrocarbon feedstream was not first processed in the membrane separations unit (305) of the present invention. The vacuum resid stream typically has a final boiling point of greater than about 1100° F. at atmospheric pressure. This enriched saturates content vacuum resid stream can be an excellent feedstock for producing commercial grade heavy lubricants. With the present invention, due to the unique compositional separations it can obtain, it may be possible to make an enriched saturates content vacuum resid from a crude or heavy hydrocarbon feed which may be utilized as a lube basestock feed from crudes or heavy hydrocarbon feeds that otherwise would not be able to produce a vacuum resid stream with properties sufficient to produce commercial grade lubricant oils. In a preferred embodiment at least a portion of the first vacuum resid stream (355) is further processed in a solvent deasphalter unit wherein the solvent deasphalter product is utilized in the production of a lube oil. In a preferred embodiment, the levels of asphaltenes in the first vacuum resid stream (355) may be at a low enough level to allow at least a portion of the second vacuum resid stream to be processed in a lube extraction unit or dewaxing unit without the need for solvent deasphalting.

Continuing with FIG. 3, at least one saturates depleted retentate product stream (325) is withdrawn from the retentate zone (320) of the membrane separations unit. The saturates depleted retentate product stream or a portion thereof is sent to a second atmospheric distillation column (360) and a second atmospheric resid stream (365) is drawn from the second atmospheric distillation column and at least a portion of the second atmospheric resid stream may be utilized as a feed to a second vacuum distillation column (370). The atmospheric resid stream typically is comprised of hydrocarbon compounds with an initial boiling point of at least about 650° F. (343° C.) at atmospheric pressure.

A second virgin gas oil (or "VGO") stream (375) is preferably drawn from the second vacuum distillation column (370). The VGO stream typically has a boiling range of about 650 to about 1050° F. at atmospheric pressure. In a preferred embodiment, at least a portion of the second VGO stream (375) is sent for further processing in a catalytic cracking ("FCC") unit, a hydrodesulfurization unit, and/or a fuels hydrocracking unit.

The second vacuum resid stream (380) from the second vacuum distillation column (370) stream will be lower in saturates content than if the heavy hydrocarbon feedstream was not first processed in the membrane separations unit (305) of the present invention. The vacuum resid stream typically has a final boiling point of greater than about 1100° F. at atmospheric pressure. In a preferred embodiment at least a portion of the second vacuum resid stream (380) is further processed in a Fluid Coking unit, a Flexicoking unit or a delayed coking unit. In another preferred embodiment at least a portion of the second vacuum resid stream (380) is further processed in a visbreaking unit, a partial oxidation ("POX") unit or in a carbon black production unit. Most preferably, the second vacuum resid stream (380) is utilized in an asphalt unit or a fuel oil production unit.

In another embodiment, a portion of the retentate product stream (325) is segregated into a second retentate stream (395) and sent to a Fluid Coking unit, a Flexicoking unit, a delayed coking unit, an asphalt production unit, or a fuel oil production unit. In still another embodiment, all of the retentate product stream (325) bypasses the second atmospheric distillation column and second vacuum distillation column thereby eliminating the need for the second atmospheric and second vacuum distillation columns and associated equipment, and at least a portion of the second retentate stream (395) is sent to a Fluid Coking unit, a Flexicoking unit, a delayed coking unit, an asphalt production unit, or a fuel oil production unit.

Figure 4:
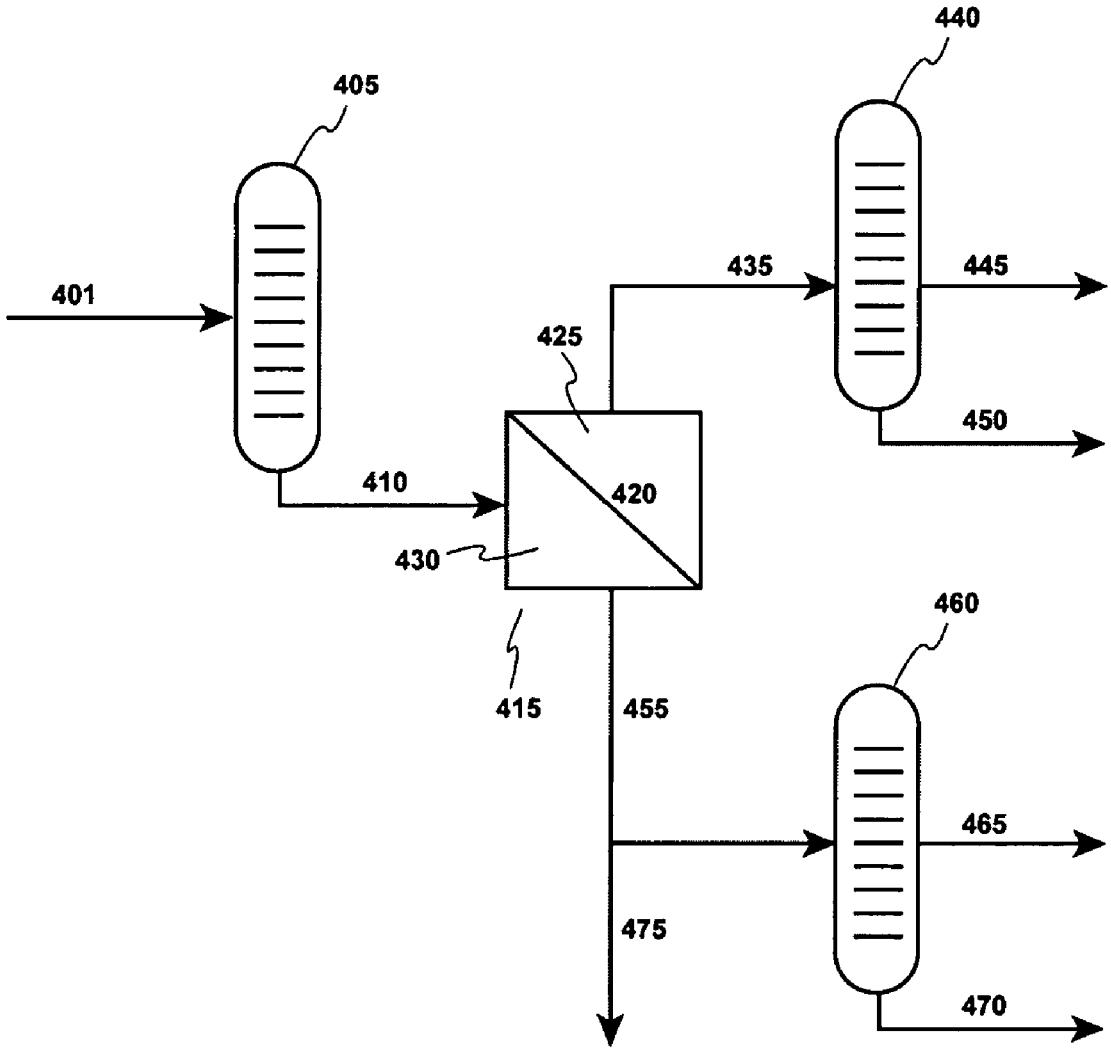
FIG. 4 illustrates one embodiment of the ultrafiltration process of the present invention wherein the heavy hydrocarbons feedstream is first distilled in an atmospheric distillation column and the atmospheric resid obtained is utilized as a feedstream to the ultrafiltration membrane separations unit. At least a portion of the saturates enriched permeate product stream and saturates depleted retentate product stream obtained from the ultrafiltration membrane separations are then processed in separate vacuum distillation columns and/or at least a portion of the saturates depleted retentate product stream is conducted to another refinery processing unit.

FIG. 4 illustrates another preferred embodiment of the present invention. In contrast with the embodiment of FIG. 3, in the embodiment shown in FIG. 4, a heavy hydrocarbon feedstream (401), such as whole crudes, topped crudes, synthetic crude blends, shale derived oils, bitumen derived oils, tar sand derived oils, or a portion thereof is first sent to an atmospheric distillation column (405) and the atmospheric resid stream (410) or a portion thereof is utilized as a feedstream to the ultrafiltration membrane separations unit (415). The atmospheric resid stream typically is comprised of hydrocarbon compounds with an initial boiling point of at least about 650° F. (343° C.) at atmospheric pressure. In this embodiment, most of the heavy hydrocarbons to be separated are concentrated in the atmospheric resid prior to being separated in the membrane separations unit (415). This allows for a significant decrease in the size, capacity, and cost of the membrane separations unit as compared to the embodiment illustrated in FIG. 3 while still maintaining most of the process benefits. For clarity, associated auxiliary equipment as well as optional column distillations are not shown in FIG. 4.

Here, in FIG. 4, the atmospheric resid stream (410) contacts one side of at least one membrane element (420) in a retentate zone (430) of the membrane separations unit (415). The membrane separates the atmospheric resid stream and selectively allows a fluid composition that has an enriched content of saturates components to pass through the membrane into the permeate zone (425) which can be withdrawn as at least one saturates enriched permeate product stream (435). At least one saturates depleted retentate product stream (455) is withdrawn from the retentate zone (430) of the membrane separations unit.

In this embodiment, the enriched-saturates content permeate product stream (435) or a portion thereof is processed further processed as a feedstream to a first vacuum distillation column (440). A first vacuum gas oil ("VGO") stream (445) is preferably drawn from the first vacuum distillation column (440). The VGO stream typically has a boiling range of about 650 to about 1050° F. at atmospheric pressure. Since this first VGO stream will be higher in saturates content than if the atmospheric resid stream was not first processed in the membrane separations unit (415) of the present invention, the VGO will be of a composition for an improved feed to a steam cracker unit, lubes extraction/dewaxing unit, lubes hydrocracker unit or a lubes hydrodewaxing unit. In a preferred embodiment, at least a portion of the first VGO stream (445) is sent to a steam cracker unit, lubes extraction/dewaxing unit, lubes hydrocracker unit or a lubes hydrodewaxing unit. It should be noted that with the present invention, due to the unique compositional separations it can obtain, it may be possible to make an enriched saturates content VGO from a crude or heavy hydrocarbon feed which may be utilized as a lube basestock feed from crudes or heavy hydrocarbon feeds that otherwise would not be able to produce a VGO stream with properties sufficient to produce commercial grade lubricant oils. This enriched saturates content VGO stream can be an excellent feedstock for producing commercial grade lubricants.

Similarly, the first vacuum resid stream (450) from the first vacuum distillation column (440) will be higher in saturates content than if the heavy hydrocarbon feedstream was not first processed in the membrane separations unit (415) of the present invention. The vacuum resid stream typically has a final boiling point of greater than about 1100° F. at atmospheric pressure.

This enriched saturates content vacuum resid stream can be an excellent feedstock for producing commercial grade heavy lubricants. With the present invention, due to the unique compositional separations it can obtain, it may be possible to make an enriched saturates content vacuum resid from a crude or heavy hydrocarbon feed which may be utilized as a lube basestock feed from crudes or heavy hydrocarbon feeds that otherwise would not be able to produce a vacuum resid stream with properties sufficient to produce commercial grade lubricant oils. In a preferred embodiment at least a portion of the first vacuum resid stream (450) is further processed in a solvent deasphalter unit wherein the solvent deasphalter product is utilized in the production of a lube oil. In a preferred embodiment, the levels of asphaltenes in the first vacuum resid stream (450) may be at a low enough level to allow at least a portion of the second vacuum resid stream to be processed in a lube extraction unit or dewaxing unit without the need for solvent deasphalting.

The saturates depleted retentate product stream (455) may be utilized as a feed to a second vacuum distillation column (460). The dispositions of the vacuum distillation column product streams of the present embodiment are similar to the those shown in the embodiment of FIG. 3. A second VGO stream (465) is preferably drawn from the second vacuum distillation column (460). The VGO stream typically has a boiling range of about 650 to about 1050° F. at atmospheric pressure. In a preferred embodiment, at least a portion of the second VGO stream (465) is sent for further processing in a catalytic cracking ("FCC") unit, a hydrodesulfurization unit, or a fuels hydrocracking unit.

In the embodiment of FIG. 4, the second vacuum resid stream (470) from the second vacuum distillation column (460) stream will be lower in saturates content than if the heavy hydrocarbon feedstream was not first processed in the membrane separations unit (415) of the present invention. The vacuum resid stream typically has final boiling point of greater than about 1100° F. at atmospheric pressure. In a preferred embodiment at least a portion of the second vacuum resid stream (470) is further processed in a Fluid Coking unit, a Flexicoking unit or a delayed coking unit. In another preferred embodiment at least a portion of the second vacuum resid stream (470) is further processed in a visbreaking unit, a partial oxidation ("POX") unit or in carbon black production. Most preferably, due to the lowered saturates content and higher asphaltene content of this stream, the second vacuum resid stream (470) is utilized in asphalt or fuel oil production.

In another embodiment, a portion of the depleted retentate product stream (455) is segregated into a second retentate stream (475) and sent to a Fluid Coking unit, a Flexicoking unit, a delayed coking unit, a fuel oil production unit, a visbreaker unit, or an asphalt unit. In still another embodiment, all of the depleted retentate product stream (455) bypasses the second vacuum distillation column thereby eliminating the need for the second vacuum distillation column and associated equipment, and at least a portion of the second retentate stream (475) is sent to a Fluid Coking unit, a Flexicoking unit, a delayed coking unit, a fuel oil production unit, a visbreaker unit, or an asphalt unit.

Although the embodiments of the present invention illustrated in FIGS. 3 and 4 allow continuous segregation and operation of permeate and retentate streams, these embodiments require multiple sets of distillation equipment to separately distill each the permeate and retentate streams obtained from the process. The embodiments shown in FIGS. 5 and 6 allow at least a portion of the permeate and retentate product streams to be segregated and stored in tankage to allow the use of the present invention with a single atmospheric distillation column and a single vacuum distillation column. For clarity, associated auxiliary equipment as well as optional column distillations are not shown in FIGS. 5 and 6.

Figure 5:
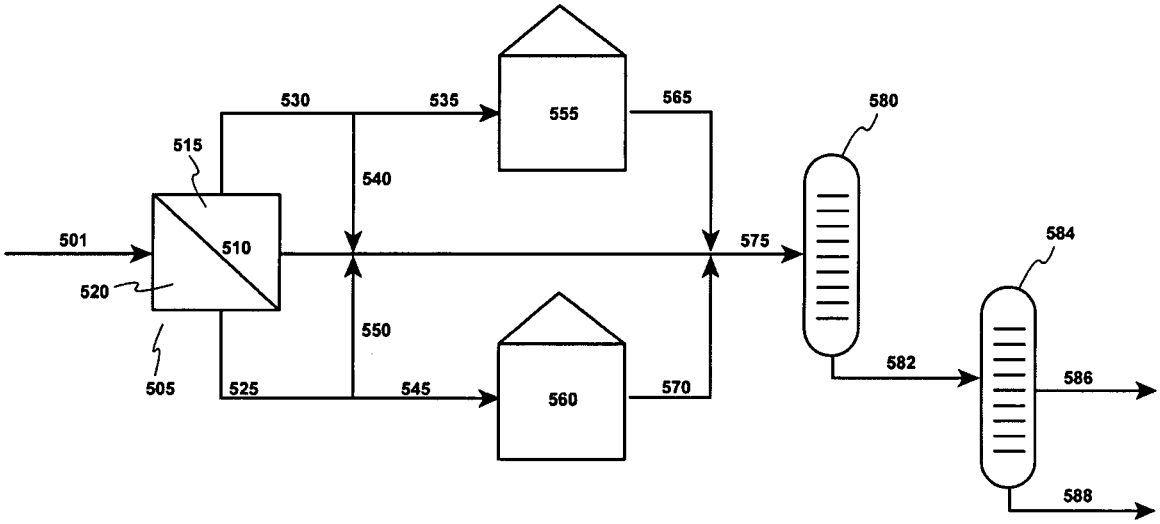
FIG. 5 illustrates one embodiment of the ultrafiltration process of the present invention where at least a portion of the saturates enriched permeate product stream and saturates depleted retentate product stream obtained from the ultrafiltration membrane separations can be individually either sent directly to an atmospheric distillation column or to separate tankage to allow the utilization of the separations process with a single atmospheric distillation column and a single vacuum distillation column.

FIG. 5 illustrates one embodiment of the present invention wherein a heavy hydrocarbon feedstream (501), such as whole crudes, topped crudes, synthetic crude blends, shale derived oils, bitumen derived oils, tar sand derived oils, or a portion thereof is fed to the ultrafiltration membrane separations unit (505) where it contacts one side of at least one membrane element (510) in a retentate zone (520) of the membrane separations unit (505). The membrane separates the heavy hydrocarbon feedstream and selectively allows a fluid composition that has an enriched content of saturates material to pass through the membrane into the permeate zone (515) which can be withdrawn as at least one saturates enriched permeate product stream (530). At least one saturates depleted retentate product stream (525) is withdrawn from the retentate zone (520) of the membrane separations unit.

In this embodiment, from 0 to 100% of the permeate product stream (530) can be segregated into a permeate tankage inlet stream (535) and an atmospheric distillation column permeate feedstream (540). Similarly, from 0 to 100% of the retentate product stream (525) can be segregated into a retentate tankage inlet stream (545) and an atmospheric distillation column retentate feedstream (550). In this manner, at any given time, from 0 to 100% of the permeate product stream (530) can be fed to the atmospheric distillation column (580) and from 0 to 100% of the retentate product stream (525) can be fed to the atmospheric distillation column (580). At any given time, from 0 to 100% of the permeate product stream (530) can be segregated into a permeate tankage inlet stream (535) and stored in the permeate product tank (555). As required, the stored permeate product can be removed from storage as a permeate tankage outlet stream (565) and reintroduced into the combined atmospheric distillation column feedstream (575) to the atmospheric distillation column (580). In a similar manner, at any given time, from 0 to 100% of the retentate product stream (525) can be segregated into a retentate tankage inlet stream (545) and stored in the retentate product tank (560). As required, the stored retentate product can be removed from storage as a retentate tankage outlet stream (570) and reintroduced into the combined atmospheric distillation column feedstream (575) to the atmospheric distillation column (580).

This embodiment allows the segregated permeate and retentate product streams to be recombined in ratios to allow continuous or block operations of the atmospheric distillation column feedstream. In block operations, the permeate product and retentate concentrations of the atmospheric distillation column feedstream would be altered during different blocks of time to allow for differing product compositions to be obtained from the single atmospheric distillation column (580) and single vacuum distillation column (584).

Continuing with FIG. 5, an atmospheric resid stream (582) is drawn from the atmospheric distillation column and at least a portion of the atmospheric resid stream is utilized as a feed to a crude vacuum distillation column (584). The atmospheric resid stream typically is comprised of hydrocarbon compounds with an initial boiling point of at least about 650° F. (343° C.) at atmospheric pressure. A vacuum gas oil ("VGO") stream (586) is preferably drawn from the vacuum distillation column (584). When the atmospheric distillation column feedstream (575) is highly concentrated in permeate product as compared to retentate product, at least a portion of the VGO stream (586) with an improved saturates content is further processed in a steam cracker unit, lubes extraction/dewaxing unit, lubes hydrocracker unit or a lubes hydrodewaxing unit. When the atmospheric distillation column feedstream (575) is significantly concentrated in retentate product as compared to permeate product, at least a portion of the VGO stream (586) with a depleted saturates content is further processed in a catalytic cracking ("FCC") unit, a hydrodesulfurization unit, or a fuels hydrocracking unit.

A vacuum resid stream (588) is drawn from the vacuum distillation column (584). While the atmospheric distillation column feedstream (575) is significantly concentrated in permeate product as compared to retentate product, at least a portion of the vacuum resid stream (588) with an improved saturates content is further processed in a solvent deasphalter unit wherein the solvent deasphalter product is utilized in the production of a lube oil. While the atmospheric distillation column feedstream (575) is highly concentrated in retentate product as compared to permeate product, at least a portion of the vacuum resid stream (588) with a depleted saturates content is further processed in a Fluid Coking unit, a Flexicoking unit, a delayed coking unit, a visbreaking unit, a partial oxidation ("POX") unit, a carbon black production unit, an asphalt unit or a fuel oil production unit.

Figure 6:
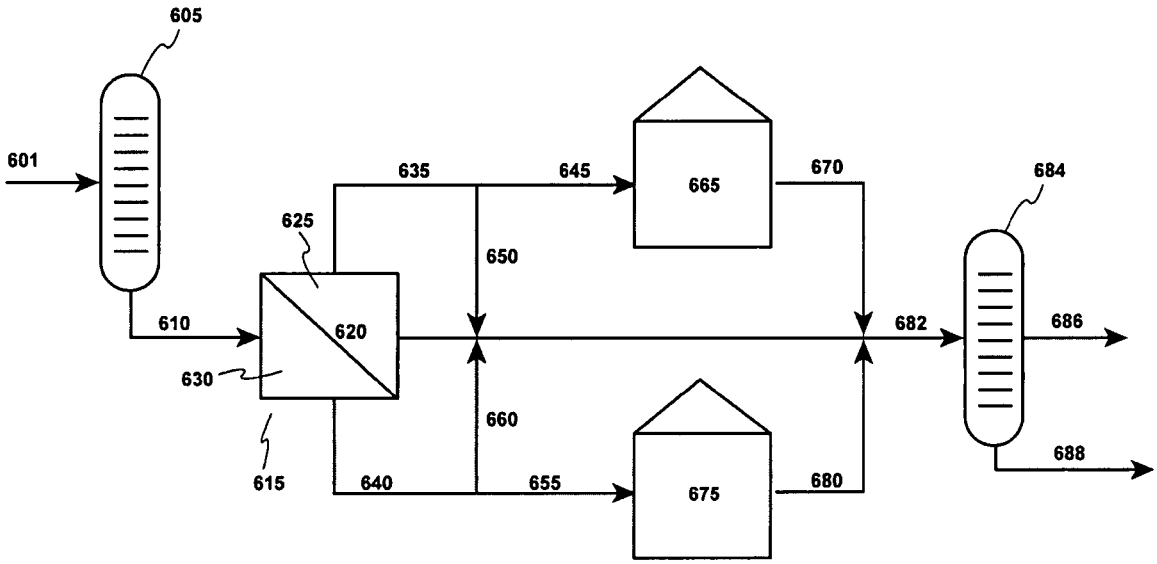
FIG. 6 illustrates one embodiment of the ultrafiltration process of the present invention where the heavy hydrocarbons feedstream is first distilled in an atmospheric distillation column and the atmospheric resid obtained is utilized as a feedstream to the ultrafiltration membrane separations unit. At least a portion of the saturates enriched permeate product stream and saturates depleted retentate product stream obtained from the ultrafiltration membrane separations unit can be individually either sent directly to a vacuum distillation column or to tankage to allow the utilization of the separations process with a single atmospheric distillation column and a single vacuum distillation column.

Another embodiment is illustrated in FIG. 6, wherein a heavy hydrocarbon feedstream (601), such as whole crudes, topped crudes, synthetic crude blends, shale derived oils, bitumen derived oils, tar sand derived oils, or a portion thereof is first sent to an atmospheric distillation column (605) and the atmospheric resid stream (610) or a portion thereof is utilized as a feedstream to the ultrafiltration membrane separations unit (615). The atmospheric resid stream typically is comprised of hydrocarbon compounds with an initial boiling point of at least about 650° F. (343° C.) at atmospheric pressure. In this embodiment, most of the heavy hydrocarbons to be separated are concentrated in the atmospheric resid prior to being separated in the membrane separations unit (615). The atmospheric resid stream (610) contacts one side of at least one membrane element (620) in a retentate zone (630) of the membrane separations unit (615). The membrane separates the atmospheric resid stream and selectively allows a fluid composition that has an enriched content of saturates components to pass through the membrane into the permeate zone (625) which can be withdrawn as at least one saturates enriched permeate product stream (635). At least one saturates depleted retentate product stream (640) is withdrawn from the retentate zone (630) of the membrane separations unit.

In this embodiment, from 0 to 100% of the permeate product stream (635) can be segregated into a permeate tankage inlet stream (645) and a vacuum distillation column permeate feedstream (650). Similarly, from 0 to 100% of the retentate product stream (640) can be segregated into a retentate tankage inlet stream (655) and a vacuum distillation column retentate feedstream (660). In this manner, at any given time, from 0 to 100% of the permeate product stream (635) can be fed to the vacuum distillation column (684) and from 0 to 100% of the retentate product stream (640) can be fed to the vacuum distillation column (684). At any given time, from 0 to 100% of the permeate product stream (635) can be segregated into a permeate tankage inlet stream (645) and stored in the permeate product tank (665). As required, the stored permeate product can be removed from storage as a permeate tankage outlet stream (670) and reintroduced into the combined vacuum distillation column feedstream (682) to the vacuum distillation column (684). In a similar manner, at any given time, from 0 to 100% of the retentate product stream (640) can be segregated into a retentate tankage inlet stream (655) and stored in the retentate product tank (675). As required, the stored retentate product can be removed from storage as a retentate tankage outlet stream (680) and reintroduced into the combined vacuum distillation column feedstream (682) to the vacuum distillation column (684).

This embodiment allows the segregated permeate and retentate product streams to be recombined in ratios to allow continuous or block operations of the vacuum distillation column feedstream. In block operations, the permeate product and retentate concentrations of the vacuum distillation column feedstream would be altered during different blocks of time to allow for differing product compositions to be obtained from single vacuum distillation column (684).

Continuing with FIG. 6, the combined vacuum distillation column feedstream (682) is fed to the vacuum distillation column (684). A vacuum gas oil ("VGO") stream (686) is preferably drawn from the vacuum distillation column (684). The VGO stream typically has a boiling range of about 650 to about 1050° F. at atmospheric pressure. When the vacuum distillation column feedstream (682) is highly concentrated in permeate product as compared to retentate product, at least a portion of the VGO stream (686) with an improved saturates content is further processed in a steam cracker, lubes extraction/dewaxing unit, lubes hydrocracker or a lubes hydrodewaxing unit. When the vacuum distillation column feedstream (682) is highly concentrated in retentate product as compared to permeate product, at least a portion of the VGO stream (686) with a depleted saturates content is further processed in a catalytic cracking ("FCC") unit, a hydrodesulfurization unit, and/or a fuels hydrocracking unit.

A vacuum resid stream (688) is drawn from the vacuum distillation column (684). The vacuum resid stream typically has final boiling point of greater than about 1100° F. at atmospheric pressure. When the vacuum distillation column feedstream (682) is significantly concentrated in permeate product as compared to retentate product, at least a portion of the vacuum resid stream (688) with an improved saturates content is further processed in a solvent deasphalter wherein the solvent deasphalter product is utilized in the production of a lube oil. When the vacuum distillation column feedstream (682) is significantly concentrated in retentate product as compared to permeate product, at least a portion of the vacuum resid stream (688) with a depleted saturates content is further processed in a Fluid Coking unit, a Flexicoking unit, a delayed coking unit, a visbreaking unit, a partial oxidation ("POX") unit, a carbon black production unit, an asphalt unit or a fuel oil production unit.

Although the present invention has been described in terms of specific embodiments, it is not so limited. Suitable alterations and modifications for operation under specific conditions will be apparent to those skilled in the art. It is therefore intended that the following claims be interpreted as covering all such alterations and modifications as fall within the true spirit and scope of the invention.

The Examples below are provided to illustrate the improved product qualities and the benefits from specific embodiments of the current invention for producing an improved product stream from a heavy hydrocarbon containing feedstream via ultrafiltration with the membranes and operating conditions of the present invention. These Examples only illustrate specific embodiments of the present invention and are not meant to limit the scope of the current invention.

EXAMPLES

Example 1

In this Example, a commercial crude distillation unit atmospheric resid was utilized as the heavy hydrocarbon feedstream to the ultrafiltration process. The atmospheric resid was permeated in a batch membrane process using an 8 kD (kiloDalton) ceramic disk ultrafiltration membrane. The pore size of this membrane was estimated to be in the 0.005 to 0.010 micron (μm) range. The transmembrane pressure was held at 1000 psig and the feed temperature was adjusted between 150 to 300° C. during the test. The separations process was in a crossflow configuration wherein the hydrocarbon feedstream was flowed across the face of the membrane and the retentate was collected and returned to a feed supply chamber containing the hydrocarbon feedstream. Select permeate samples and retentate samples were extracted during the test and the flux rates and permeate yields were measured during testing. Select samples were analyzed for saturates, aromatics, resin, and polars content in an latroscan analyzer.

The latroscan analysis procedure utilized is described further as follows. The latroscan performs quantitative analysis by detection of zones separated on a Chromorod thin layer using a GC type hydrogen Flame Ionization Detector (FID). The Chromorod is a quartz rod coated with a thin layer of sintered silica or alumina on which the sample is developed and separated at an advanced constant speed through a hydrogen flame by which the organic substance is separated on the thin layer and ionized through the energy obtained from the flame. Affected by an electric field applied to the poles of the FID, the ions generate an electric current with the intensity proportional to the amount of each organic substance entering the flame thereby enabling a quantitative determination. Typically, 1 microliter of a sample is spotted at a marked position on the Chromorod. The rods are placed in solvent tanks for varying times for "development." The rods are dipped in the tanks to the level where the rod was spotted with the sample. Development, i.e. moving the species down the length of the rod is done at room temperature. In the First Phase of Development, n-Heptane is utilized for 35 min. (moves the Saturates). In the Second Phase of Development, Toluene is utilized for 15 min. (moves the Aromatics). In the Third Phase of Development, Methylene Chloride/Methanol at 0.95/0.5 ratio is utilized for 2 min. (moves the Resins). The fourth group, i.e., the Polars, remains near the spotting location. The sample rods are then fed at a controlled rate through a hydrogen flame to create the gases analyzed by FID. Generally four well separated peaks are quantified.

The test conditions, flux rates, yields, and select permeate and retentate latroscan compositional results are tabulated in Table 1. As noted above, the retentate obtained from the process was recycled to a feed chamber containing the hydrocarbon feedstream (i.e., the atmospheric resid) and both overall feed supply and the retentate were over the course of the experiment gradually depleted of the components contained in the permeate. As can be seen from the data in Table 1, the saturates content of the permeate products obtained were consistently higher than all of the retentate samples during the testing. It should be noted that although the latroscan analysis utilized in analyzing the samples this Example separates the components into "Saturates", "Aromatics", "Resins" and "Polars", the Resins and Polars are primarily aromatic molecules and a total "aromatics" content of a sample as defined in the definitions above is best estimated by summing the values of the "Aromatics", "Resins" and "Polars" for each sample shown in Table 1. The total "saturates" content of a sample as defined in the definitions above is approximately the value of the "Saturates" as shown in Table 1.

TABLE 1

| Sample | Transmembrane Pressure (psi) | Feedstream Temperature (° C.) | Permeate Flux Rate (gal/ft$^2$/day) | Permeate Yield, Cumulative (% of Initial Feed) | Saturates (wt %) | Aromatics (wt %) | Resins (wt %) | Polars (wt %) |
|---|---|---|---|---|---|---|---|---|
| Atmospheric Resid Feed | | | | | 17.3 | 62.0 | 11.8 | 9.0 |
| Permeate Sample 1 | 1000 | 250 | 28.80 | 15.3 | 20.5 | 62.0 | 10.7 | 7.3 |
| Retentate Sample 1 | 1000 | 250 | — | 17.9 | 17.5 | 60.9 | 12.5 | 9.1 |
| Permeate Sample 2 | 1000 | 250 | 9.59 | 23.8 | — | — | — | — |

TABLE 1-continued

| Sample | Transmembrane Pressure (psi) | Feedstream Temperature (° C.) | Permeate Flux Rate (gal/ft$^2$/day) | Permeate Yield, Cumulative (% of Initial Feed) | Saturates (wt %) | Aromatics (wt %) | Resins (wt %) | Polars (wt %) |
|---|---|---|---|---|---|---|---|---|
| Permeate Sample 3 | 1000 | 250 | 8.25 | 28.3 | 27.4 | 65.7 | 5.9 | 1.0 |
| Permeate Sample 4 | 1000 | 150 | 1.52 | 33.3 | — | — | — | — |
| Permeate Sample 5 | 1000 | 151 | 0.76 | 44.7 | 33.4 | 61.9 | 4.3 | 0.9 |
| Retentate Sample 5 | 1000 | 151 | — | 47.3 | 12.9 | 62.4 | 13.5 | 11.2 |
| Permeate Sample 6 | 1000 | 300 | 14.78 | 56.0 | — | — | — | — |
| Permeate Sample 7 | 1000 | 298 | 30.09 | 60.5 | — | — | — | — |
| Permeate Sample 8 | 1000 | 300 | 17.77 | 65.7 | — | — | — | — |
| Retentate Sample 8 | 1000 | 300 | — | 67.8 | — | — | — | — |
| Permeate Sample 9 | 1000 | 300 | 9.67 | 71.5 | — | — | — | — |
| Permeate Sample 10 | 1000 | 300 | 7.74 | 74.7 | 21.0 | 65.7 | 10.4 | 3.0 |
| Retentate Sample 10 | 1000 | 300 | — | 75.6 | 11.8 | 57.6 | 16.4 | 14.2 |

Referring to Table 1, the original Atmospheric Resid Feed had a saturates content of 17.3 wt %. The first permeate sample (Permeate Sample 1) retrieved from the process was analyzed and as can be seen, had a saturates content of 20.5 wt % which is an 18% increase (1.18 times) in saturates content as compared to the feedstream. Permeate Sample 3 which was obtained a little further into the run under the same process conditions as Permeate Sample 1 better exemplifies the steady states condition of the process as compared to Permeate Sample 1. Here, Permeate Sample 3 had a saturates content of 27.4 wt % which is a 58% increase (1.58 times) in saturates content a compared to the Atmospheric Resid Feed. It is noted that the actual increase in saturates between the permeate-side and the feed-side streams was probably even greater than this as it is noted above in that the retentate recycle was continually decreasing in its overall saturates content in the feedstream to the membrane module. Comparison of the results of Permeate Sample 5 and Retentate Sample 5 in Table 1 exemplifies this point.

As can be seen from Table 1, Permeate Sample 5 had a saturates content of 33.4 wt %. A sample of the retentate (Retentate Sample 5) was taken at about the same point in the experiment and analyzed for content. This Retentate Sample 5 had a saturates content of only about 12.9 wt % and is a close representative of the composition of the feedstream at the time that Permeate Sample 5 was taken. Reviewing the compositions, Permeate Sample 5 had a saturates content that was 93% greater (1.93 times) than the saturates content of the initial Atmospheric Resid Feed and 159% greater (2.59 times) than the saturates content of Retentate Sample 5 which closely resembles the composition of the feed when Permeate Sample 5 was taken.

The final permeate sample (Permeate Sample 10) from the experimental example run was analyzed as well as a corresponding final retentate sample (Retentate Sample 10). Analyzing this data similar to Samples 5 above, Permeate Sample 10 had a saturates content of 21.0 wt %. A corresponding sample of the retentate (Retentate Sample 10) was taken at about the same point in the experiment and analyzed for content. This Retentate Sample 10 had a saturates content of only about 11.8 wt % and is a close representative of the composition of the feedstream at the time that Permeate Sample 10 was taken. Reviewing the compositions, Permeate Sample 10 had a saturates content that was 21% greater (1.21 times) than the saturates content of the initial Atmospheric Resid Feed and 78% greater (1.78 times) than the saturates content of Retentate Sample 10 which closely resembles the composition of the feed when Permeate Sample 10 was taken.

This example shows that a heavy hydrocarbon stream can be separated according to ultrafiltration process of the presently claimed invention to produce a permeate product stream with a significantly improved saturates content.

Example 2

In this Example, additional separations and analyses were performed on Permeate Sample 5 and Retentate Sample 5 obtained from Example 1 above. Each of these two samples were separated into saturates, aromatics, resins, and asphaltenes components by a silica-gel SARA analysis (which is known in the art). The component samples were then analyzed with a Simulated Distillation gas chromatography analysis ("SIMDIS") to determine the boiling point distribution of each of the component samples. The data obtained from the SIMDIS analysis of the saturates components obtained from Permeate Sample 5 were compared to the data obtained from the SIMDIS analysis of the saturates components obtained from Retentate Sample 5. The results are presented in FIG. 2 which shows the ratio of saturates content of Permeate Sample 5 to the saturates content of Retentate Sample 5 as a function of boiling points.

As can be seen in FIG. 2, the ratio of the saturates wt % content in Permeate Sample 5 to the saturates wt % content in Retentate Sample 5 was greater than 1.0 for all saturates components with boiling points less than about 1100° F. Additionally, average of the saturates wt % content in Permeate Sample 5 to the saturates wt % content in Retentate Sample 5 was greater than about 2.0 for those components with boiling points below about 900° F. This indicates that the process can be used to significantly affect fuel range producing processes, steam cracking, or lighter lubes production by segregating an enriched saturates stream in the molecular weights utilized for fuels upgrading processes and/or fuels products (e.g., gasoline, kerosene, and diesel). Thus it is demonstrated that the increase in saturates concentration in the permeate stream is not simply derived from the removal of heavier components of lower saturates levels, but additionally by the selective permeation of lighter saturated species.

These examples illustrate the significantly increased saturates content streams that can be produced in accordance with the present invention.

What is claimed is:

1. A process for separating a heavy hydrocarbon stream, comprising:

a) contacting the heavy hydrocarbon stream having a final boiling point of at least 1100° F. with at least one porous membrane element comprised of a ceramic membrane in a membrane separation zone wherein the heavy hydrocarbon stream contacts a first side of the porous membrane element;

b) retrieving at least one permeate product stream from a second side of the porous membrane element, wherein the permeate product stream is comprised of selective materials which pass through the porous membrane element from the first side of the porous membrane element and are retrieved in the permeate product stream from the second side of the porous membrane element;

c) retrieving at least one retentate product stream from the first side of the porous membrane element;

d) conducting at least a portion of the permeate product stream to a first atmospheric distillation column;

e) retrieving a first atmospheric resid stream from the first atmospheric distillation column; and f) conducting at least a portion of the first atmospheric resid stream to a first vacuum distillation column, wherein a ratio of a saturates wt % content of the permeate product stream to a saturates wt % content of the heavy hydrocarbon stream is greater than 1.0, and wherein the porous membrane element has an average pore size of about 0.001 to about 2 microns and a transmembrane pressure across the porous membrane element is at least 400 psig.

2. The process of claim 1, wherein the heavy hydrocarbon stream in the membrane separation zone is from about 100° C. to about 350° C.

3. The process of claim 2, wherein the transmembrane pressure across the porous membrane element is at least 700 psig.

4. The process of claim 3, wherein the ratio of the saturates wt % content of the permeate product stream to the saturates wt % content of the heavy hydrocarbon stream is greater than 1.2.

5. The process of claim 2, further comprising:

conducting at least a portion of the retentate product stream to a second atmospheric distillation column;

retrieving a second atmospheric resid stream from the second atmospheric distillation column; and conducting at least a portion of the second atmospheric resid stream to a second vacuum distillation column.

6. The process of claim 5, wherein the heavy hydrocarbon stream is comprised of a process stream selected from a whole crude, a topped crude, a synthetic crude blend, a shale derived oil, an oil derived from bitumen, and an oil derived from tar sands.

7. The process of claim 6, wherein the ratio of the saturates wt % content of the permeate product stream to the saturates wt % content of the heavy hydrocarbon stream is greater than 1.2.

8. The process of claim 7, wherein the transmembrane pressure across the porous membrane element is at least 700 psig.

9. The process of claim 2, further comprising:

conducting at least a portion of the retentate product stream to a Fluid Coking unit, a Flexicoking unit, a delayed coking unit, an asphalt production unit, or a fuel oil production unit;

wherein the wherein the ratio of the saturates wt % content of the permeate product stream to the saturates wt % content of the retentate product stream is greater than 1.2.

10. The process of claim 9, wherein the transmembrane pressure across the porous membrane element is at least 700 psig.

11. A process for separating a heavy hydrocarbon stream, comprising:

a) contacting the heavy hydrocarbon stream having a final boiling point of at least 1100° F. with at least one porous membrane element comprised of a ceramic membrane in a membrane separation zone wherein the heavy hydrocarbon stream contacts a first side of the porous membrane element;

b) retrieving at least one permeate product stream from a second side of the porous membrane element, wherein the permeate product stream is comprised of selective materials which pass through the porous membrane element from the first side of the porous membrane element and are retrieved in the permeate product stream from the second side of the porous membrane element;

c) retrieving at least one retentate product stream from the first side of the porous membrane element;

d) conducting at least a portion of the permeate product stream to a storage tank;

e) conducting at least a portion of the permeate product stream from the storage tank to an atmospheric distillation column;

f) retrieving a first atmospheric resid stream from the first atmospheric distillation column; and g) conducting at least a portion of the first atmospheric resid stream to a first vacuum distillation column;

wherein a ratio of a saturates wt % content of the permeate product stream to a saturates wt % content of the heavy hydrocarbon stream is greater than 1.0, and wherein the porous membrane element has an average pore size of about 0.001 to about 2 microns and a transmembrane pressure across the porous membrane element is at least 400 psig.

12. The process of claim 11, wherein the heavy hydrocarbon stream in the membrane separation zone is from about 100° C. to about 350° C. and the transmembrane pressure across the porous membrane element is at least 700 psig.

13. The process of claim 12, wherein the ratio of the saturates wt % content of the permeate product stream to the saturates wt % content of the heavy hydrocarbon stream is greater than 1.2.

14. The process of claim 1, wherein the at least one porous membrane element consists of ceramic.

15. The process of claim 11, wherein the at least one porous membrane element is consists of ceramic.

16. The process of claim 1, wherein the heavy hydrocarbon feedstream is flowed across the face of the at least one porous membrane element, and the flow in the membrane separation zone is at a Reynolds Number of at least 2000.

17. The process of claim 11, wherein the heavy hydrocarbon feedstream is flowed across the face of the at least one porous membrane element, and the flow in the membrane separation zone is at a Reynolds Number of at least 2000.

* * * * *